United States Patent [19]

Minter

[11] Patent Number: 4,486,066

[45] Date of Patent: Dec. 4, 1984

[54] CONNECTOR AND CLIP THEREFOR

[76] Inventor: Jerry B. Minter, Components Corporation, Denville, N.J. 07834

[21] Appl. No.: 367,159

[22] Filed: Apr. 12, 1982

[51] Int. Cl.[3] ..... H01R 9/09

[52] U.S. Cl. ..... 339/176 MP; 339/256 R

[58] Field of Search ..... 339/176 MF, 176 MP, 339/256 R, 258 R, 17 M, 17 C, 176 R, 176 M

[56] References Cited

U.S. PATENT DOCUMENTS

| | | | |
|---|---|---|---|
| 3,246,280 | 4/1966 | Scagnelli | 339/176 MP X |
| 3,340,440 | 9/1967 | Minter | 339/176 MP |
| 3,587,029 | 6/1971 | Knowles | 339/176 MP |
| 4,119,357 | 10/1978 | Bonhomme | 339/176 MP |
| 4,324,451 | 4/1982 | Ammon et al. | 339/176 MP |

*Primary Examiner*—William R. Briggs

*Attorney, Agent, or Firm*—Donald P. Gillette

[57] ABSTRACT

A wire connector to be soldered to a printed circuit mother board has two J-shaped outer legs and a central bight integrally formed with the legs and comprising juxtaposed contact portions to receive the edge connector of another such board. The outer legs and the central bight are in a common plane and the outer legs have flexure portions of reduced thickness. The thickness is reduced in the plane so that the flexibility of the wire is increased in that direction, making it easier to flex the legs to shift the location of the contact portions. Thus, a line of such contact portions on a row of clips can easily be brought into exact alignment to receive the other board without the necessity of using a jig to align all of the clips when they are attached to the mother board.

15 Claims, 8 Drawing Figures

CONNECTOR AND CLIP THEREFOR

BACKGROUND OF THE INVENTION

1. Field of the Invention

This invention relates to wire connector clips that have two outer legs spaced apart in a plane for insertion of their ends into holes in a support structure to which the legs are to be rigidly attached, part of each leg being curved toward the other leg to join to a reverse-bent portion with two contact regions spaced apart to receive the edge of the conductive structure, such as the edge-connector portion of a printed circuit board, and another part of each leg, located between the curved part and the end of that leg, being formed, as by coining, into a flexure portion of reduced thickness of the wire. Each flexure portion is located between the curved part of the leg and the end, and the direction of the force that produces the thickness reduction is in the plane common to the legs to allow the curved portions, especially the contact regions, of the clip to be moved laterally in the plane relative to the rigidly held ends. In particular, this invention relates to an improvement in clips of the type described in my U.S. Pat. No. 3,340,440 to permit a row of such clips to be soldered to one printed circuit board, but not necessarily in exact alignment with each other, yet with enough flexibility to shift the contact regions so that the straight edge-connector portion of a second printed circuit board can be easily inserted between the contact portions of all of the clips in the row.

2. The Prior Art

Connector clips of the type described in U.S. Pat. No. 3,340,440 are typically mounted individually in printed circuit boards of the type frequently referred to as "mother boards". These are electrically non-conducting boards with conductive interconnections formed thereon to a number of circuits and particularly to connector clips spaced to grasp and make contact with edge-connector pads on other printed circuit boards, known as "daughter boards". In order to accommodate the daughter boards, the individual connector clips must be properly aligned with respect to each other.

While these clips may be made in different configurations, the most common type is M-shaped, with two outer supporting legs and a U-shaped central bight. Physical and electrical contact between each clip and one of the edge connector pads are formed by two small, juxtaposed regions on opposite sides of the U-shaped bight portion. When assembled on a mother board, the outer legs of each clip are rigidly soldered into plated holes in a printed circuit mother board, and the daughter board can later be removably inserted into the central bight portion. The clips may be individually inserted, but there are usually many edge-connector pads on the edge of each daughter board, and the printed circuit boards are normally designed so that there is at least one clip, and sometimes two, to make contact with each edge-connector pad. Since printed circuit boards are usually flat to a high degree of precision, it is essential that all of the contact portions of all of the clips expected to engage the edge-connector pads of a given daughter board will be precisely aligned with each other. The holes into which the outer legs of each clip are inserted are slightly larger in diameter than the legs themselves so that the legs can be inserted easily. However, this makes it possible for the clips that are supposed to be aligned with each other to be slightly out of line when they are soldered into place, thus making an imprecise row into with the daughter board must be fitted. To attempt to fit a daughter board into such improperly located connector clips would require such great pressure to be placed on the daughter board that it would be likely to break either the mother board or the daughter board or, more likely, to be impossible to accomplish. For this reason, it has been the practice heretofore to align a group of connector clips before they are soldered into place and to hold them in such alignment during the soldering operation. They may be aligned by placing a bar or jig of precise thickness in the bight portions of the row of clips and leaving the bar or jig engaged with the clips during the soldering operation.

Such an alignment procedure is unnecessary in the attachment of other components to a printed circuit board and adds an additional step of complexity to the formation of a completed board.

Manufacturers who either make or buy basic printed circuit boards and then insert components, such as integrated circuits, capacitors, resistors, transistors, and other devices into holes formed in specific locations to receive the conductive leads of such components frequently have automatic insertion devices to insert the leads into the proper holes. After all of the components have been put into their proper positions, their conductive leads are simultaneously soldered into position in a wave-soldering device. Since no further mechanical connections are normally expected to be made between such components and any other devices, it is not necessary that the components be located with great precision. However, that is not the case for conductor clips which, as previously described, must be soldered into exact locations to receive the edge-connector pads of another printed circuit board.

The resistors, capacitors, and other devices to be fed into the automatic insertion devices just mentioned are frequently attached to strips of adhesive material would on reels, each of which may contain dozens or hundreds of a specific component. As each printed circuit board passes through the automatic insertion device, the board is brought into a specific position relative to the inserting mechanism, and the leads of the component to be inserted into specific holes in the board in that operation are clipped from the adhesive strip, bent if necessary, and guided into the holes. Then the board is indexed to another position relative to the inserting mechanism and another component is similarly placed in holes formed to receive it.

It would be desirable to use the same sort of mechanism to insert connector clips, but the requirement for high precision in locating the clips has heretofore made it impossible, or at least difficult, to do so.

Various forms of jigs of the type shown in my U.S. Pat. No. 4,061,405 can be used to hold a number of the clips to allow them to be inserted as a group into a printed circuit board and to be held in proper location during the time they are being soldered rigidly into place. However such jigs are not suitable for the type of automatic feeding devices used for insertion of resistors and other such components, and they require either hand assembly or the development of a different type of automatic feeding device.

OBJECTS AND SUMMARY OF THE INVENTION

It is one of the objects of the present invention to provide an improved form of connector clips that simplifies insertion and alignment in a printed circuit board.

Another object is to provide a clip suitable for packaging with hundreds of other similar clips on a strip of adhesive material to be fed into an automatic insertion device similar to those used for insertion of other components into a printed circuit board.

Still another object is to provide a method of forming improved connector clips suitable for use with automatic insertion devices.

A further object is to provide an improved multi-clip connector in which slightly misaligned clips are rigidly held but are provided with flexure portions that allow them to be moved relatively easily and with minimum force into proper alignment to receive a printed circuit board or a similar connecting member.

A still further object is to provide an improved method of handling connector clips and assembling them onto a printed circuit board.

In accordance with the present invention, wire clips are made with two J-shaped outer legs, each of which has a flexure portion between its two ends. One of the ends is straight and of generally circular cross section to be inserted into a slightly larger hole in a printed circuit board, and the other end is bent toward the other part of the clip. The flexure portions are formed by flattening, or coining, a portion of the wire so that the flattened portion has greater flexibility in a direction perpendicular to its planar surface than does any part of the wire prior to the flattening. The location of the flattened flexure portion along the respective outer legs is such that, upon insertion of the ends into holes in a printed circuit board, the flattened portions are adjacent, and preferably slightly inside, the holes in the printed circuit board in which the respective clip is mounted. The holes in the printed circuit board are slightly larger in diameter than the rounded part of the wire, which facilitates entry of the wire, but the flattened flexure portions extend laterally outward to a maximum distance greater than the diameter of the holes, and it is this increase in dimension in one direction that causes the edges of the flattened portions to engage the walls of the holes. This not only helps make good contact with the plating on the walls but also helps hold the clips in place prior to the soldering operation.

Preferably the flattening is accomplished by feeding the round wire between pressure members that apply force from opposite sides of the wire. Thereafter the portion of the wire between each pair of such flattened portions is bent into the desired convoluted shape of the clip, with the portions of the wire that include the two flattened portions being substantially parallel to each other and constituting the outer legs of the clip. These legs are cut long enough the engage a strip of adhesive material that extends perpendicularly to the legs and is located between the flattened portions and the outermost ends thereof.

The direction of flattening of the wire at the flexure portions is such that the largest transverse dimension of these portions is perpendicular to the plane of the clip. This provides the greatest resilient flexibility of the flexure portions in this plane and allows the clip to be pressed transversely in that plane with minimal force to align the bight of each clip with the bight of the other clips in the group that is to make contact with the edge-connector pads of one daughter board.

By making the outer legs longer than is necessary to be soldered in place in a printed circuit board, a large number of clips can be attached to a strip of adhesive material placed perpendicularly to the legs and adjacent the extremities thereof. This is same arrangement used for attaching other electrical components to an adhesive strip, in particular, those components that have two wire connectors extending in the same direction, such as disc-type capacitors. The adhesive strip, or preferably two such strips attached face-to-face on opposite sides of the legs with the adhesive surface on each adherently joined to the adhesive surface of the other, can be wound on a reel with the attached connector clips and then fed into the same type of insertion apparatus as used to isert other electrical components into printed circuit boards. In so doing, it is common for the insertion apparatus to grasp each component, which would be a clip in this instance, sheer off the connecting wires at some predetermined point between the adhesive strip and the main part of the component, position the wire connecting portions properly with respect to holes in a printed circuit board, and insert the cut-off wire ends of the component into the appropriate holes.

By arranging the flexure portions on the wire outer legs of the connector clips so that they extend at least slightly into the printed circuit board material before the bight portion butts against the surface of the printed circuit board, the outwardly extending edges of the flexure portions can hold the clips in place well enough to prevent them from being easily jiggled loose by movement of the printed circuit board between the time the clips are inserted and the time the board is placed on a wave-soldering machine to affix the clips permanently to the board.

DETAILED DESCRIPTION OF THE INVENTION

Figure 1:
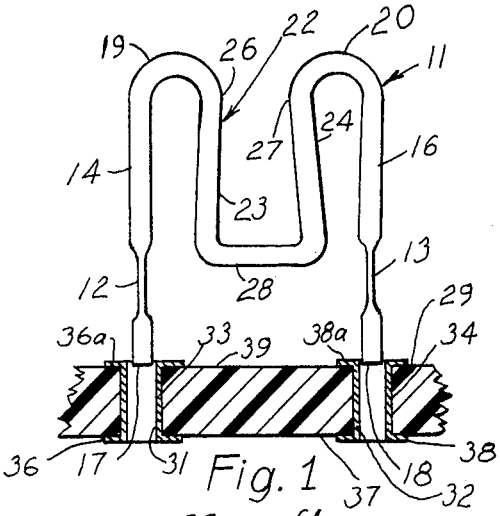
FIG. 1 shows a cross-section of a printed circuit board with one embodiment of the connector clip constructed according to the present invention and shown in plan view.

FIG. 1 shows a connector clip 11 constructed according to the general configuration of the M-shaped connector clips in my U.S. Pat. No. 3,340,440 but with flexure portions 12 and 13 at intermediate regions along the outer legs 14 and 16 of the clip. In the position in which the clip is illustrated in FIG. 1, the portion of the outer legs 14 and 16 below the flexure portions 12 and 13 is straight and is severed perpendicularly at the respective end 17 and 18 thereof. Above the respective flexure portions 12 and 13, the legs 14 and 16 are bend toward each other at curved portions 19 and 20, which gives the legs 14 and 16 a generally J-shaped configuration.

The inwardly curved upper end of the legs 14 and 16 merges continuously with a U-shaped portion 22 that defines a central bight between the outer legs 14 and 16. Since the entire clip 11 is formed of one piece of wire, generally of round configuration shown, and modified to form the flexure portions 12 and 13, the curved portions 19 and 20 extend intergrally to side members 23 and 24 of the U-shaped bight 22. As may be seen, and as is described in considerable detail in my prior U.S. Pat. No. 3,340,440, the sides 23 and 24 of the U-shaped bight 12 are not precisely parallel with each other but are farther apart toward the bottom thereof than they are at the contact areas 26 and 27. These contact areas are the regions at which the connector clip makes electrical and physical contact with a printed circuit board inserted into the U-shaped bight 22, and it is an important advantage of the round wire connector clip 11 that the contact areas 26 and 27 not only make concentrated contact with edge connector pads of the printed circuit board inserted therebetween but, by virture of their shape, which is rounded in all directions in a shape generally similar to the central part of a prolate spheroid, the plating material that forms the edge connector pads is wiped clean in the contact area as it is inserted between the connector regions 26 and 27 yet there are no sharp corners to abrade the plating material that forms the pads.

At the lowest part of the sides 23 and 24, the same wire that forms those sides also includes a central bottom portion 28. A particularly satisfactory type of wire is beryllium-copper having a diameter of 0.0201". The flexure portions 12 and 13 are regions of the wire reduced to a thickness of about one-fourth the diameter of the wire by spreading the metal laterally without allowing it to lengthen greatly. The maximum lateral dimension of the flexure portions would then be approximately three times the diameter of the wire.

The connector clip 11 in FIG. 1 is shown partially inserted into a printed circuit board 29 that has two holes 31 and 32 into which the ends 17 and 18 have been inserted. For receiving clips made of 0.0201" thick wire, these holes are preferably drilled by means of a #72 drill and therefore have a diameter of about 0.025", which is slightly larger than the diameter of the wire but substantially less than the maximum lateral dimension of the flexure portions 12 and 13. This allows the ends 17 and 18 to be easily inserted, even though the holes have metal-plated walls 33 and 34, respectively, which reduce their diameter slightly. The plating material that forms the wall 33 of the hole 31 extends between a pad 36 on the surface 37 and a pad 36*a* on the surface 39, and the metal that forms the wall 34 extends between similar pads 38 and 38*a* on the printed circuit board.

The central portion 28 of the U-shaped bight 22 of the connector clip 11 forms an abutment member that limits the extent to which the legs 14 and 16 can be forced into the holes 31 and 32.

Figure 2:
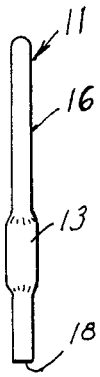
FIG. 2 is a side view of the connector clip in FIG. 1.

FIG. 2 shows only the leg 16 of the clip 11 from a position 90° removed from the plan view in FIG. 1. In the side view in FIG. 2, the lateral extension of the flexure portion 13 may be easily seen. This flexure portion, like the other flexure portion 12, is formed by exerting high pressure on opposite sides of the wire of which the connector clip 11 is made. Such a technique is also referred to as coining. The pressure is preferably applied before the bends are formed in the wire, and as may be seen, the direction of flattening requires that the pressure be applied in directions that will correspond, eventually, to the plane of the connector clip 11. More specifically, it is the plane that passes through the centers of both the legs 14 and 16 and all portions of the central U-shaped bight 22.

It is also desirable that the ends of the flexure portion 13 in FIG. 2 not constitute a sharp modification of the round cross section of the wire of which the connector clip 11 is formed. It is desirable for the coining pressure to be applied in such a way that the cross-section of the wire at each end of the flexure portion 13 have a relatively smooth transition from the round configuration to the flat configuration. This prevents any concentrated stress area from being created, and in order to make the flexure portions are flexible as possible, and to maintain the strength and integrity of the connector clip 11, it is desirable to perform a suitable annealing treatment on the clip 11 after it has been formed.

Figure 3:
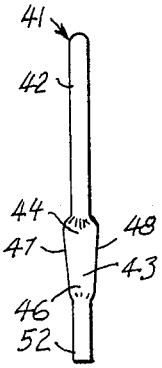
FIG. 3 is a side view of a modified embodiment of the connector clip according to the invention.
Figure 4:
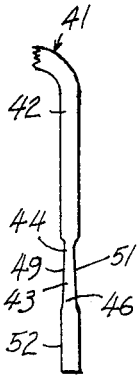
FIG. 4 is a partial plan view of a fragment of the connector clip in FIG. 3.

FIGS. 3 and 4 show part of a modified connector clip 41, and specifically one leg 42 thereof. The difference between this leg and the leg 16 in FIG. 2 is that the leg 42 has a flexure portion in which the coining pressure is applied in such a way that the upper end 44 of the flexure portion 43 is thinner than the lower end 46 thereof. Thus, in the side view in FIG. 3, the outer edges 47 and 48 of the flexure portion 43 flare outwardly toward the top 44 of the flexure portion. In FIG. 4, the sides 49 and 51 of the flexure portion 43 slant inwardly toward the top 44 thereof. This leaves the upper part of the flexure portion 43 flexible, but allows the lower part toward to lower end 52 of the leg 41 to be forcibly inserted more easily into a hole, such as the hole 32 in FIG. 1.

Figure 5:
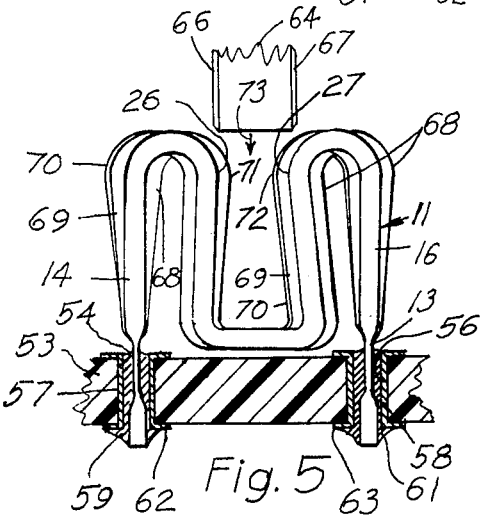
FIG. 5 is a cross-sectional view of a printed circuit board with a row of connector clips soldered therein and viewed from one end of the row.
Figure 6:
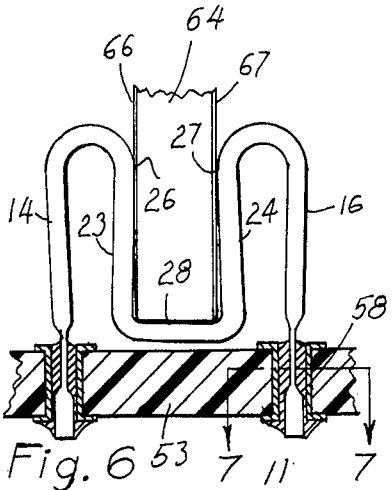
FIG. 6 shows the same cross-sectional view of the printed circuit board in FIG. 5 with all of the connector clips in the row aligned by insertion of a second printed circuit board.

FIGS. 5 and 6 are particularly illustrative of one of the main advantages of the present invention. In FIG. 5 a fragment of a printed circuit board 53 is shown in cross section. Two of the holes 54 and 56 in this board are also shown in the cross-sectional plane, and each of them is a plated-through hole with metallic plating 57 and 58 defining the walls of the respective holes 54 and 56, although plated through holes are not essential to the invention. The same M-shped connector clip 11 of FIG. 1 is shown permanently attached to the printed circuit board 53 by means of solder connections 59 and 61 between the respective ends 17 and 18 of the legs 14 and 16 of the clip 11 and two printed circuit connector pad 62 and 63 formed integrally with the plating material defining the walls 57 and 58 of the holes 54 and 56.

Directly behind the holes 54 and 56 are respective rows of holes, such as are typically formed in a mother board to receive a plurality of connectors like the connector 11 in position to make connection with a plurality of connector pads on the edges of a daughter board 64. In FIG. 5 only the end of the daughter board 64 is visible and only the two connector pads 66 and 67 to make contact with the contact regions 26 and 27 of the first connector clip 11 are visible. Connector pads similar to the pads 66 and 67 are located on the lower part of the opposite sides of the board 64 directly behind the pads 66 and 67.

A plurality of connectors 68–70 identical with the connector 11 are shown off-set to varying degrees from the desired position of perfect alignment directly behind the connector 11. Connector 68 is the one directly behind the connector 11, and as may be seen, it is off-set to the right from the position of correct alignment directly behind the connector 11. Another connector 69 is off-set to the left, and the third connector 70 is off-set even farther to the left. One of the reasons that the connectors can be off-set in either direction and by varying amounts is that the wire forming each of the connectors has a slightly smaller diameter than the hole in which that connector is inserted in the row of holes directly behind the holes 54 and 56. Unless the connectors are each held in position of specific alignment with the connector 11, some of them can tilt or shift to the left and others to the right. As a result, the combined effect of the bights of the connectors is to produce an opening that is apparently narrower than the opening of any one connector, alone. As is shown in FIG. 5, the thickness of the daughter board 64, including the thickness of the pads 66 and 67, is much greater than the distance between the contact region 71 of the connector 68 and the contact region 72 of the connector 70. In the absence of the flexure portions, such as the flexure portions 12 and 13 of the clip 11 and corresponding flexure portions of all of the other clips, it would be extremely difficult, and in some cases impossible, to insert the printed circuit board 64 into the combined bight regions of the slightly misaligned connectors.

However, the flexure portions of the outer legs of each of the connectors allows them to be shifted laterally in their respective planes so that they can be directly aligned with each other, as shown in FIG. 6 in which each of the connector clips is directly behind the first clip 11 and thus invisible from the end view of FIG. 6. The printed circuit board 64 has been inserted into the U-shaped bight regions of all of the connector clips by easily shifting the clips laterally to the extent necessary, and the lowermost edge of the board 64 has been brought into abutment against the region where the side members 23 and 24 bend inwardly to form the lowermost part 28 of the clip 11 and of corresponding portions of the other clips directly aligned behind that one.

As a result of the added flexibility in the lateral direction, it is unnecessary to take special precautions or to use special alignment jigs or holding means to hold the connector clips in proper alignment before they are soldered in place. This materially reduces the time and the manipulative effort required to assemble the group of connector clips, and thus reduces the cost of using them while still retaining the advantage of their extreme light weight, as compared with connectors that require relatively heavy plastic forms to hold the individual conductive parts.

Figure 7:
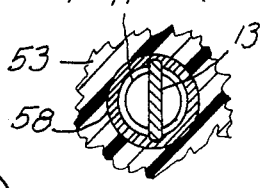
FIG. 7 is a cross-sectional view taken on the sectional line *7bii—bii* in FIG. 6.

FIG. 7 shows the way that the flexure member 13 is forced into the conductive wall plating 58 in the printed circuit board 53. The fact that the edges of the flexure portion 13 score into the conductive plating 58 improves the electrical contact between these conductive members and, as previously mentioned, helps hold the clip 11 rather firmly in place even before it is soldered rigidly to the conductive wall 58.

In order for the edge of the flexure portion to extend into the hole sufficiently for the edges of the flexure portion to engage the plating around the hole, as shown in FIG. 7, it is necessary for the lowermost part of the flexure portion to be below the central portion 28 of the bight of the connector clip 11, as shown in FIG. 6, for example. However, the entire part of the flexure portion cannot be located within the hole or the flexibility will be lost. Thus it is important that a substantial part of the flexure portions 12 and 13 in FIG. 6 extend above the lowermost part 28 of the bight.

Figure 8:
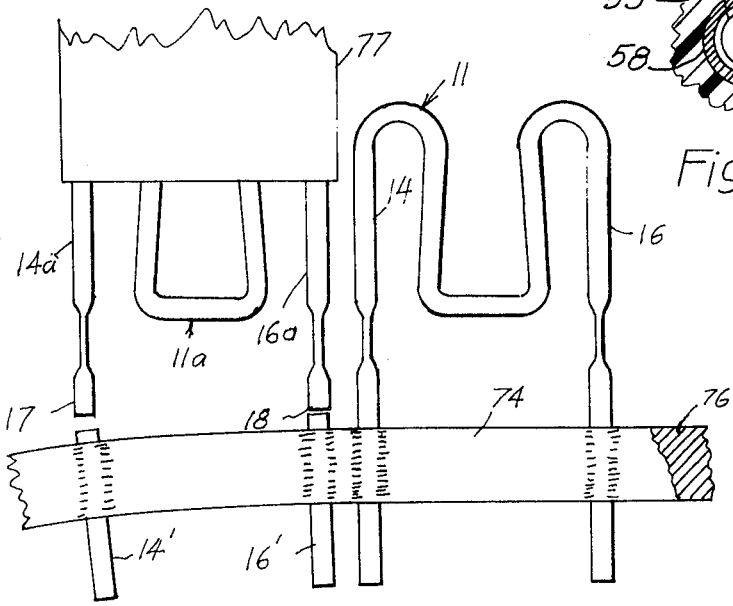
FIG. 8 shows a fragment of tape with connector clips attached to it and in the process of being severed from it in accordance with the technique facilitated by the present invention.

FIG. 8 shows an adhesive strip 74 attached to extended portions of the legs 14 and 16 of the clip 11 and to corresponding extended portions of the legs **14*a* and 16*a* of the clip 11*a*. Although only two clips 11 and 11*a* are shown, it is to be understood that the adhesive strip 74 would be long enough to have a large number of other such clips attached to it. In order to prevent the adhesive material on the strip 74 from becoming attached to other clips or to other parts of itself when wound upon a reel, it is customary that the strip be formed with a backing strip 76, which may also have an adhesive surface to adhere firmly to the adhesive surface on the strip 74. In that case, as is customary when such adhesive strips are used to hold capacitors and other electronic components, the extensions of the wire forming the legs 14 and 16 and 14*a* and 16*a* are clamped between the two adhesive strips 74 and 76**.

In order to insert each of the clips, in turn, into proper holes in the printed circuit board, the combined adhesive strips 74 and 76 are moved along to the left in the representation in FIG. 8, and at a certain position, the nibs of a gripping member 77 grip the upper portion of the respective clip, which is the clip **11*a* in FIG. 8, while sheering means (not shown) sheer off the extended portions 14' and 16' of the legs 14*a* and 16*a* to leave the severed ends 17 and 18. The gripping member 77 is controlled in a well known manner to position the ends 17 and 18 in direct alignment with suitable holes, such as the holes 31 and 32 in FIG. 1** to allow the clip to be held within those holes as has been described previously in this specification.

As the next connector clip 11 is indexed into position to be grasped by the gripping member 77, the extensions of the legs 14 and 16 are likewise severed and the clip 11 is inserted by the gripping member into another set of holes in the printed circuit board that has been indexed into position to receive the legs 14 and 16.

While the invention has been described in terms of specific embodiments it will be understood to those skilled in the art that modifications may be made therein without departing from the true scope of the invention.

What is claimed is:

1. A connector clip formed of a single piece of resilient wire, said clip comprising:

first and second co-planar outer legs of resilient wire, each of the outer legs having a curved end and an opposite end;

a U-shaped portion integrally formed of the same piece of resilient wire as the outer legs and having a central bight and two sides that extend from the bight, each of the sides comprising a contact area confronting the contact area of the other side and spaced a predetermined distance from the contact area of the other side, the free end of each of the sides being connected to a respective one of the curved ends of the outer legs, whereby the free ends of the sides of the U-shaped portion merge directly into the curved ends to form a generally M-shaped clip; and first and second flexure portions integrally formed of the wire intermediate the curved end and the opposite end of the first and second outer legs respectively, the cross-sectional dimension of each of the flexure portions being increased in a direction at an angle to the common plane of the co-planar outer legs and reduced perpendicular to that direction to allow the flexure portions to bend more easily in said common plane than adjacent portions of the outer legs can.

2. The invention according to claim 1 in which the direction of maximum increase of the cross-section of each of the flexure portions is substantially perpendicular to the common plane of the co-planar outer legs.

3. The invention according to claim 1 in which the flexure portions are defined by substantially flat portions of the wire.

4. The invention according to claim 3 in which the cross-section of the wire except at the flexure portions is substantially round.

5. The invention according to claim 1 in which each of the flexure portions is thinner toward one of its ends than it is toward the other of its ends.

6. The invention according to claim 5 in which each of the flexure portions is thinner near the end thereof closer to the curved end of that leg than it is toward the opposite end.

7. The connector clip of claim 1 in which the part of each of the flexure portions farthest removed from the curved end of the respective outer leg is farther from the respective curved portion than is the central part of the bight.

8. The connector clip of claim 1 in which part of each of the flexure portions closest to the curved end of the respective outer leg is closer to the respective curved end than is the central part of the bight.

9. The invention according to claim 1 in which the bight of the U-shaped portion is directly between part of each of the flexure portions of the outer legs of that clip.

10. The invention according to claim 1 in which the bight and the adjacent part of the two sides of the U-shaped portion are directly between the major part of the lengths of the flexure portions of the outer legs of that connector clip.

11. A connector comprising:

a plurality of connector clips, each comprising:

first and second co-planar outer legs of resilient wire, each of the outer legs having a curved end and an opposite end, and first and second flexure portions integrally formed of the wire intermediate the curved end and the opposite end of the first and second outer legs, respectively, the cross-sectional dimension of each of the flexure portions being increased in a direction at an angle to the common plane of the co-planar outer members and reduced perpendicular to that direction to allow the flexure portions to bend more easily in the common plane than adjacent portions of the outer legs can;

a U-shaped member integrally formed of the same piece of resilient wire as the outer legs and having a central bight and two sides that extend from the bight and are connected to respective ones of the curved ends of the outer legs of the same clip, each of the sides comprising a contact area confronting the contact area of the other side and spaced a predetermined distance from the contact area of the other side, the wire that comprises the outer members and the U-shaped member having a substantially round, uniform cross-section of known diameter over a substantial part of its length except for the flexure portions;

an insulating substrate comprising two substantially straight, parallel rows of holes, each of the holes in one of the rows corresponding to one of the holes in the other row to constitute, therewith, a pair of holes spaced apart by a distance substantially equal to the distance between the opposite ends of the outer legs of one of the clips; and conductive means adhering to the surface of the substrate intersecting each of the holes, each of the outer legs of each of the clips being positioned in a respective one of the pairs of holes therefor and soldered to the conductive means intersecting the respective hole, each of the flexure portions being between the substrate and the respective curved end.

12. The invention as defined in claim 11 in which the extent of the cross-sectional dimension of each of the flexure members in said direction is greater than the dimension of the respective hole in the substrate in the same direction, whereby the flexure portions engage the walls of the respective holes.

13. The invention as defined in claim 12 in which the cross-sectional shape and size of that portion of each of the outer legs between the respective flexure portions and the opposite end of that outer leg is smaller than the cross-sectional dimension of the hole into which that portion of the respective outer leg is inserted, whereby insertion of the clips into the substrate is facilitated.

14. The connector of claim 11 in which the end of each of the flexure portions farthest removed from the curved end of the respective outer leg engages the perimeter of the respective hole when the outer legs are inserted in the holes.

15. The invention according to claim 2 in which the flexure portions extend laterally from the original diameter of the wire by approximately three times the diameter of the wire.

* * * * *